US011386853B2

(12) United States Patent
Lee et al.

(10) Patent No.: US 11,386,853 B2
(45) Date of Patent: Jul. 12, 2022

(54) SOURCE DRIVER FOR GENERATING TARGET INITIALIZATION VOLTAGE AND DISPLAY DEVICE INCLUDING THE SAME

(71) Applicant: SAMSUNG DISPLAY CO., LTD., Yongin-si (KR)

(72) Inventors: Whee Won Lee, Yongin-si (KR); Myeong Su Kim, Yongin-si (KR); Bo Yeon Kim, Yongin-si (KR); Won Tae Kim, Yongin-si (KR); Jae Han Lee, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/215,670

(22) Filed: Mar. 29, 2021

(65) Prior Publication Data

US 2022/0101799 A1 Mar. 31, 2022

(30) Foreign Application Priority Data

Sep. 28, 2020 (KR) ..... 10-2020-0126344

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2310/027* (2013.01)

(58) Field of Classification Search
CPC ..... G09G 3/3291
USPC ..... 345/55
See application file for complete search history.

(56) References Cited

U.S. PATENT DOCUMENTS

| | | | | |
|---|---|---|---|---|
| 2017/0186375 | A1* | 6/2017 | Jung | G09G 3/3233 |
| 2017/0323611 | A1* | 11/2017 | Jo | G09G 3/3688 |
| 2018/0196301 | A1* | 7/2018 | Choi | G09G 3/3648 |
| 2020/0160794 | A1* | 5/2020 | Park | G09G 3/3291 |
| 2020/0168163 | A1* | 5/2020 | Kim | G09G 3/3233 |

FOREIGN PATENT DOCUMENTS

KR 101495359 B1 2/2015

* cited by examiner

*Primary Examiner* — Long D Pham
(74) *Attorney, Agent, or Firm* — Cantor Colburn LLP

(57) ABSTRACT

A display device includes: a display panel including a plurality of pixels; a source driver for outputting a target initialization voltage in an analog format to the pixels through sensing lines; and a timing controller for providing the source driver with a data control signal including packet information associated with the target initialization voltage. The packet information is in a digital format. The source driver includes a digital-analog converter which generates the target initialization voltage in the analog format, based on the packet information.

18 Claims, 10 Drawing Sheets

FIG. 8

| VINT_D4 | VINT_D3 | VINT_D2 | VINT_D1 | |
|---|---|---|---|---|
| 0 | 0 | 0 | 0 | V0 [V] |
| 0 | 0 | 0 | 1 | V1 [V] |
| ⋮ | ⋮ | ⋮ | ⋮ | ⋮ |
| 1 | 1 | 1 | 0 | V14 [V] |
| 1 | 1 | 1 | 1 | V15 [V] |

SOURCE DRIVER FOR GENERATING TARGET INITIALIZATION VOLTAGE AND DISPLAY DEVICE INCLUDING THE SAME

This application claims priority to Korean Patent Application No. 10-2020-0126344, filed on Sep. 28, 2020, and all the benefits accruing therefrom under 35 U.S.C. § 119, the content of which in its entirety is herein incorporated by reference.

BACKGROUND

1. Technical Field

The present disclosure generally relates to a source driver and a display device including the same.

2. Discussion of the Related Art

With the development of information technologies, the importance of a display device which is a connection medium between a user and information increases. Accordingly, display devices such as a liquid crystal display device and an organic light emitting display device are increasingly used.

The display device may include pixels respectively connected to scan lines and data lines, a scan driver for driving the scan lines, and a data driver for driving the data lines.

A pixel circuit may include a plurality of transistors, a capacitor, and a light emitting device. When a scan signal is supplied from a scan line, the pixel circuit may be supplied with a data voltage from a data line, and supply a current of a driving transistor according to the data voltage to the light emitting device. The light emitting device may emit light with an intensity corresponding to the current of the driving transistor.

Specifically, a magnitude of the current of the driving transistor is in proportion to the square of a voltage difference between a gate electrode and a source electrode of the driving transistor. In other words, the magnitude of the current of the driving transistor may be influenced by not only a data voltage applied to the gate electrode but also a voltage of the source electrode. Therefore, a constant reference voltage (or initialization voltage) may be applied to the source electrode so as to easily adjust the voltage difference between the gate electrode and the source electrode of the driving transistor.

SUMMARY

However, the reference voltage (or initialization voltage) may be provided in an analog form via a printed circuit board on which a power supply is mounted, a source driver in which the data driver is mounted, and a display panel in which the pixel circuit is mounted. A magnitude of the reference voltage may be changed due to influence of a self-resistance of a power line for providing the reference voltage, a bonding resistance between the printed circuit board and the source driver, a bonding resistance between the source driver and the display panel, and the like.

There has been shown a tendency that the size of a display panel is increased, and therefore, a larger number of source drivers are required. When magnitudes of reference voltages between source drivers are different from each other, a mura occurring in a vertical direction in a source driver unit may be viewed by a user of a display device.

Embodiments provide a display device capable of providing a reference voltage having a magnitude which is not changed even when a bonding resistance between a printed circuit board and a source driver and a bonding resistance between the source driver and a display panel are increased in a high-temperature and humid environment.

Embodiments also provide a display device capable of providing reference voltages having the substantially same size to a plurality of source drivers.

In accordance with an aspect of the present disclosure, there is provided a source driver including: an intra interface which receives a data control signal and outputs packet information associated with a target initialization voltage extracted from the data control signal, where the packet information is in a digital format; and a digital-analog converter which generates an initialization voltage in an analog format, based on the packet information.

The source driver may further include a logic controller disposed between the intra interface and the digital-analog converter, and the logic controller may generate a first control signal for controlling the digital-analog converter, based on the packet information.

The source driver may further include a level shifter disposed between the logic controller and the digital-analog converter, and the level shifter may boost the first control signal to a second control signal capable of operating the digital-analog converter.

The source driver may further include a buffer amplifier disposed between a sensing line and the digital-analog converter, and the sensing line may be connected to a pixel.

The digital-analog converter may include: a digital-analog converter controller which converts the second control signal to an n-bit signal; and a digital-analog converter switch unit connected to the digital-analog converter controller through n channels, and including a plurality of switches arranged in a matrix form configured with $2^n$ rows and n columns. Here, n is a natural number.

The digital-analog converter may further include a voltage divider including $2^n$ resistors electrically connected in series between a first terminal to which a driving voltage in an analog format is applied and a second terminal to which a ground voltage is applied, and the digital-analog converter switch unit may receive a plurality of initialization voltages generated by diving the driving voltage by the voltage divider and may select one of the plurality of initialization voltages as the target initialization voltage.

The voltage divider may be connected to the digital-analog converter switch unit through $2^n$ channels, and provide the plurality of initialization voltages to the digital-analog converter switch unit through the $2^n$ channels.

The plurality of switches may be configured with a combination of N-type transistors and P-type transistors. The N-type transistors and the P-type transistors may be arranged such that only switches disposed in one row among the $2^n$ rows are all turned on, corresponding to the n-bit signal.

In accordance with another aspect of the present disclosure, there is provided a display device including: a display panel including a plurality of pixels; a source driver which outputs a target initialization voltage in an analog format to the pixels through sensing lines; and a timing controller which provides the source driver with a data control signal including packet information associated with the target initialization voltage.

The packet information may be in a digital format, and the source driver may include a digital-analog converter which generates the target initialization voltage in the analog format, based on the packet information.

The source driver may further include: an intra interface which receives the data control signal and outputs the packet information included in the data control signal; and a logic controller disposed between the intra interface and the digital-analog converter, and the logic controller may generate a first control signal for controlling the digital-analog converter, based on the packet information.

The source driver may further include a level shifter disposed between the logic controller and the digital-analog converter, and the level shifter may boost the first control signal to a second control signal capable of operating the digital-analog converter.

The display device may further include a buffer amplifier disposed between the sensing lines and the digital-analog converter.

The digital-analog converter may include: a digital-analog converter controller which converts the second control signal to an n-bit signal; and a digital-analog converter switch unit connected to the digital-analog converter controller through n channels, and including a plurality of switches arranged in a matrix form configured with $2^n$ rows and n columns. Here, n is a natural number.

The display device may further include a voltage divider including $2^n$ resistors electrically connected in series between a first terminal to which a driving voltage in an analog format is applied and a second terminal to which a ground voltage is applied, and the voltage divider may output a plurality of divided voltages by dividing the driving voltage.

The voltage divider may be connected to the digital-analog converter switch unit through $2^n$ channels, and provide the divided voltages to the digital-analog converter switch unit through the $2^n$ channels.

The plurality of switches may be configured with a combination of N-type transistors and P-type transistors. The N-type transistors and the P-type transistors may be arranged such that only switches disposed in one row among the $2^n$ rows are all turned on, corresponding to the n-bit signal.

Each of the pixels may be connected to a scan line, a data line, and a sensing control line. Each of the pixels may include: a driving transistor including a first electrode connected to a first power voltage line, a second electrode connected to an anode of a light emitting device, and a gate electrode connected to a first node; a first transistor including a first electrode connected to the data line, a second electrode connected to the first node, and a gate electrode connected to the scan line; a second transistor including a first electrode connected to the sensing line, a second electrode connected to the anode of the light emitting device, and a gate electrode connected to the sensing control line; and a capacitor connected between the first node and the anode of the light emitting device.

The display panel and a printed circuit board on which the timing controller is mounted may be connected to each other by a flexible film on which the source driver is mounted.

The flexible film may be provided in a chip on film ("COF") manner or a chip on plastic ("COP") manner.

The data line may receive a part of a data signal, and the data signal may include a plurality of line image data. Each of the line image data may include start of line ("SOL") data, configuration control data, pixel data, and horizontal blank period data.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

FIG. 8 is a diagram illustrating packet information shown in FIG. 4.

DETAILED DESCRIPTION

Figure 1:
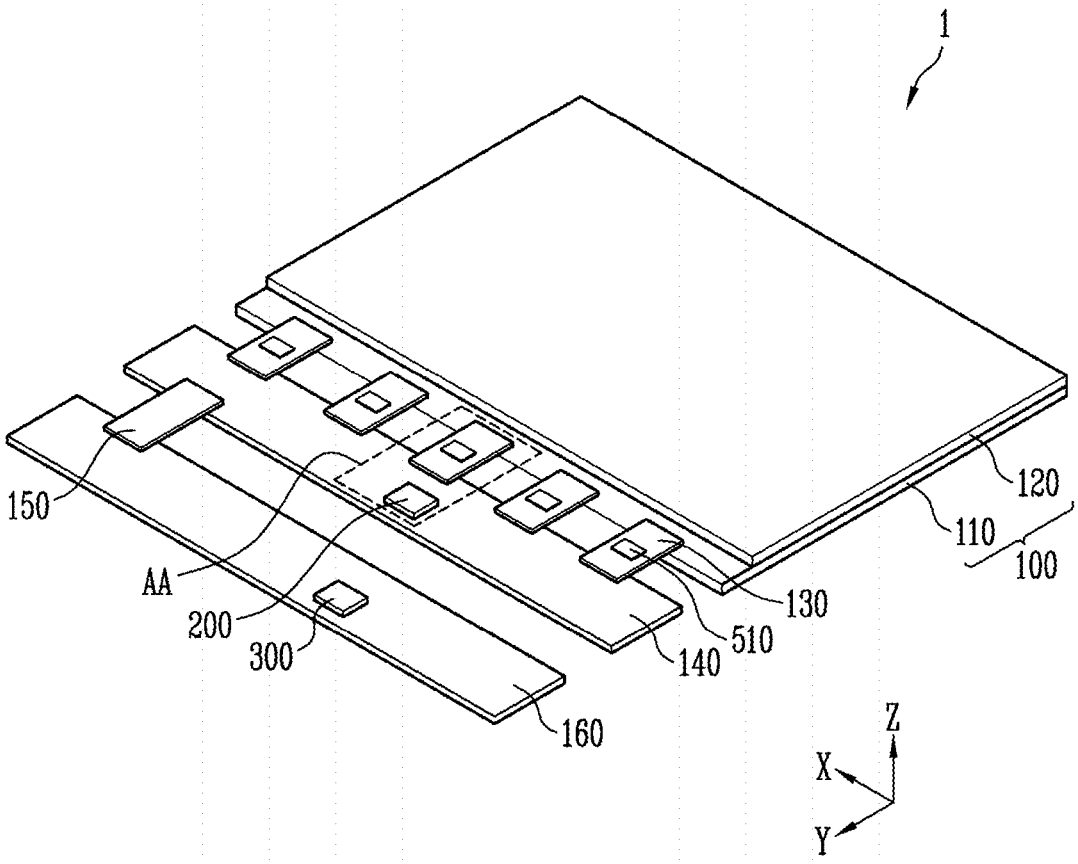
FIG. 1 is a perspective view of a display device in accordance with the present disclosure.

Hereinafter, embodiments of the present disclosure will be described in more detail with reference to the accompanying drawings. Throughout the drawings, the same reference numerals are given to the same elements, and their overlapping descriptions will be omitted. It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or to section. Thus, "a first element," "component," "region," "layer" or "section" discussed below could be termed a second element, component, region, layer or section without departing from the teachings herein. The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Figure 2:
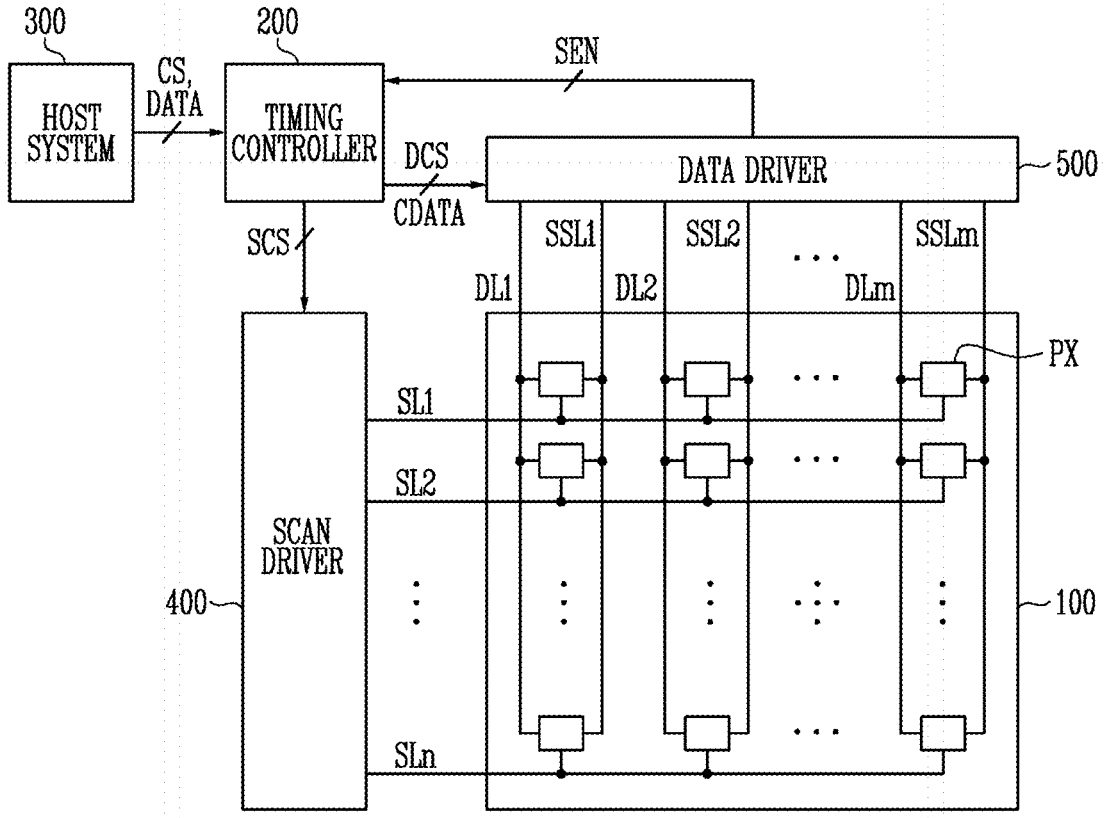
FIG. 2 is a block diagram of the display device in accordance with the present disclosure.

FIG. 1 is a perspective view of a display device in accordance with the present disclosure. FIG. 2 is a block diagram of the display device in accordance with the present disclosure.

Referring to FIGS. 1 and 2, the display device 1 may include a display panel 100, a scan driver 400, a data driver 500, flexible films 130, a first printed circuit board ("PCB") 140, a connection part 150, a second PCB 160, a timing controller ("T-con") 200, and a host system 300. Hereinafter, for convenience of description, a case where the display device 1 is an organic light emitting display device will be assumed and described. However, the present disclosure according to the invention is not limited thereto, and may be applied to various types of display devices such as a liquid crystal display device ("LCD"), an electrophoretic display ("EPD"), and an inorganic light emitting display device.

The display panel 100 may include a lower substrate 110 and an upper substrate 120. The lower substrate 110 may be a thin film transistor substrate made of plastic or glass. The upper substrate 120 may be an encapsulation substrate configured as a plastic film, a glass substrate, or a protective film.

The lower substrate 110 may include a display area and a non-display area provided at the periphery of the display area. The display area is an area in which pixels PX are provided to display an image. Scan lines SL1 to SLn (n is a positive integer of 2 or more), data lines DL1 to DLm (m is a positive integer of 2 or more), and sensing lines SSL1 to SSLm may be disposed on the lower substrate 110. The data line DL1 to DLm and the sensing lines SSL1 to SSLm may be disposed in parallel to each other. The data line DL1 to DLm and the sensing lines SSL1 to SSLm may be disposed to intersect to scan line SL1 to SLn.

The scan driver 400 may receive a scan control signal SCS input from the T-con 200. The scan driver 400 may supply scan signals to the scan lines SL1 to SLn according to the scan control signal SCS. The scan signals may include a scan signal and a sensing signal. The scan driver 400 may be formed in a gate driver in panel ("GIP") manner in the non-display area at the outside of one side or opposite sides of the display area of the display panel 100.

The data driver 500 may receive compensated image data CDATA and a data control signal DCS, which are input from the T-con 200. The compensated image data CDATA may be image data corrected by performing, on image data DATA, external compensation for compensating for a threshold voltage of a driving transistor DT and afterimage compensation for compensating for a degradation degree of a light emitting device LD. The data driver 500 may convert the compensated image data CDATA into an analog data voltage according to the data control signal DCS, and supply the analog data voltage to the data lines DL1 to DLm. Pixels PX to which the analog data voltages are to be supplied may be selected by the scan signals supplied from the scan driver 400. The selected pixels PX may be supplied with the data voltages to emit light with a predetermined luminance.

The data driver 500 may be supplied with a sensed voltage or a sensed current from the sensing lines SSL1 to SSLm. The data driver 500 may generate sensing data SEN including information on a threshold voltage of the driving transistor DT and a degradation degree of the light emitting device LD in each of the pixels PX by using the sensed voltage or the sensed current. The data driver 500 may supply the sensing data SEN to the timing controller 200.

The data driver 500 may include a plurality of source drivers 510. The source drivers 510 may be mounted on the flexible films 130, respectively. The flexible films 130 may be attached onto pads provided on the lower substrate 110, respectively, in a tape automated bonding manner by using an anisotropic conductive film ("ACF"). Since the pads are connected to the data lines DL1 to DLm, the source drivers 510 may be connected to the data lines DL1 to DLm.

Each of the flexible films 130 may be provided in a chip on film ("COF") manner or a chip on plastic ("COP") manner. A COF may include a base film such as polyimide and a plurality of conductive lead lines provided on the base film. Each of the flexible films 130 may be curved or bent. Each of the flexible film 130 may be attached to the lower substrate 110 of the display panel 100 and the first PCB 140.

The first PCB 140 may be attached to the flexible films 130. The first PCB 140 may allow the T-con 200 to be mounted thereon. The first PCB 140 may be a flexible printed circuit board ("FPCB"). The first PCB 140 may be connected to the second PCB 160 through the connection part 150.

The connection part 150 may connect the first PCB 140 and the second PCB 160. The connection part 150 may correspond to a plurality of lines including a bus as an input/output terminal to which an intra interface is applied between the timing controller 200 and the host system 300. The intra interface is an interface capable of processing a plurality of input data at a high speed. However, the present disclosure according to the invention is not limited thereto, and the connection part 150 may be implemented with an arbitrary interface capable of transmitting data and a plurality of lines including an arbitrary input/output terminal.

The second PCB 160 may supply power voltages and driving signals to the display device 1. The second PCB 160 may allow the host system 300 to be mounted thereon. The second PCB 160 may be connected to the first PCB 140 by the connection part 150.

The timing controller 200 may receive image data DATA and control signals CS, which are input from the host system 300. The host system 300 may include a system on chip ("SoC") having a scaler built therein. The host system 300 may convert image data input from the outside into a format (i.e., image data DATA) appropriate to be displayed on the display panel 100.

The control signals CS may include a vertical synchronization signal, a horizontal synchronization signal, a data-enable signal, a dot clock, and the like. The vertical synchronization signal is a signal defining one frame period. The horizontal synchronization signal is a signal defining one horizontal period required to supply data voltages to pixels PX of one horizontal line of the display panel 100. The data enable signal is a signal defining a period in which valid data is input. The dot clock is a signal repeated in a predetermined short period.

The timing controller 200 may generate a scan control signal SCS for controlling an operation timing of the scan driver 400 and a data control signal DCS for controlling an operation timing of the data driver 500, based on the control signals CS, so as to control the operation timings of the scan driver 400 and the data driver 500. The timing controller 200 may output the scan control signal SCS to the scan driver 400, and output the data control signal DCS to the data driver 500.

The timing controller 200 may receive sensing data SEN input from the data driver 500. The timing controller 200 may generate compensation data on which external compensation and afterimage compensation can be performed by using the sensing data SEN. The timing controller 200 may perform the external compensation and the afterimage compensation by using the compensation data. The timing controller 200 may provide the data driver 500 with compensated image data CDATA on which the external compensation and the afterimage compensation have been completed.

Figure 3:
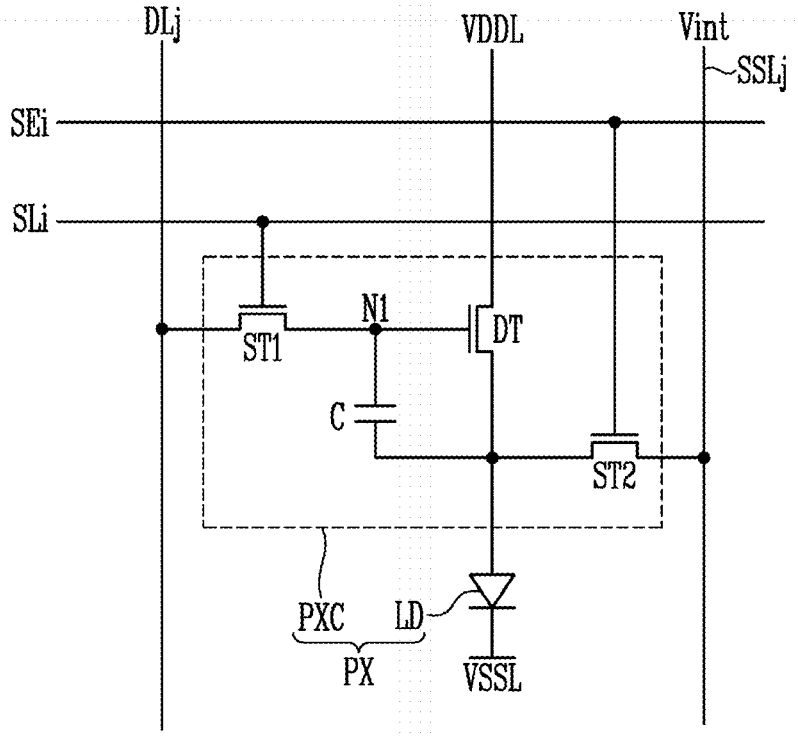
FIG. 3 is a circuit diagram illustrating an example of a pixel shown in FIG. 2.

FIG. 3 is a circuit diagram illustrating an example of a pixel shown in FIG. 2. For convenience of descriptions, a pixel PX connected to an ith (i is a positive integer satisfying 1≤i≤n) scan line SLi, an ith sensing control line SEi, a jth (j is a positive integer satisfying 1≤j≤m) data line DLj, a first power voltage line VDDL, and a jth (j is a positive integer satisfying 1≤j≤m) sensing line SSLj is exemplified in FIG. 3.

Referring to FIG. 3, the pixel PX may include a light emitting device LD and a pixel circuit PXC for supplying a driving current to the light emitting device LD. The pixel circuit PXC may include a driving transistor DT, first and second transistors ST1 and ST2, and a capacitor C.

The light emitting device LD may emit light according to a current flowing through the driving transistor DT. An anode electrode of the light emitting device LD may be connected to a source electrode of the driving transistor DT, and a cathode electrode of the light emitting device LD may be connected to a second power voltage line VSSL to which a low-potential driving voltage lower than a driving voltage is supplied.

In an embodiment, the light emitting device LD may include the anode electrode, a hole transporting layer, an organic light emitting layer, an electron transporting layer, and the cathode electrode. In the light emitting device LD, when a voltage is applied to the anode electrode and the cathode electrode, holes and electrons are moved to the organic light emitting layer through the hole transporting layer and the electron transporting layer, respectively, and are combined with each other in the organic light emitting layer, thereby emitting light.

A gate electrode of the driving transistor DT may be connected to a first electrode of the first transistor ST1, the source electrode of the driving transistor DT may be connected to the anode electrode of the light emitting device LD, and a drain electrode of the driving transistor DT may be connected to the first power voltage line VDDL. The driving transistor DT may control a current flowing from the first power voltage line VDDL to the light emitting device LD according to a voltage difference between the gate electrode and the source electrode thereof.

A gate electrode of the first transistor ST1 may be connected to the ith scan line SLi, the first electrode of the first transistor ST1 may be connected to the gate electrode of the driving transistor DT, and a second electrode of the first transistor ST1 may be connected to the jth data line DLj. The first transistor ST1 may be turned on when an ith scan signal having a gate-on voltage is supplied to the ith scan line SLi, to supply a voltage of the jth data line DLj to the gate electrode of the driving transistor DT.

A gate electrode of the second transistor ST2 may be connected to the ith sensing control line SEi, a first electrode of the second transistor ST2 may be connected to the jth sensing line SSLj, and a second electrode of the second transistor T2 may be connected to the source electrode of the driving transistor DT. The second transistor ST2 may be turned on when an ith sensing signal having a gate-on voltage is supplied to the ith sensing control line SEi, to supply a reference voltage (or target initialization voltage Vint) of the jth sensing line SSLj to the source electrode of the driving transistor DT.

In FIG. 3, the first electrode of each of the first and second transistors ST1 and ST2 may be a source electrode or a drain electrode, and the second electrode of each of the first and second transistors ST1 and ST2 may be an electrode different from the first electrode. For example, when the first electrode is a source electrode, the second electrode may be a drain electrode.

The capacitor C may include a first electrode connected to the gate electrode of the driving transistor DT and a second electrode connected to the source electrode of the driving transistor DT. The voltage difference between the gate electrode and the source electrode of the driving transistor DT may be stored in the capacitor C.

Although a case where the driving transistor DT and the first and second transistors ST1 and ST2 are implemented with an N-type metal oxide semiconductor field transistor ("MOSFET") has been mainly described in FIG. 3, the present disclosure according to the invention is not limited thereto. The driving transistor DT and the first and second transistors ST1 and ST2 may be implemented with a P-type MOSFET.

The pixel PX in accordance with the embodiment of the present disclosure includes the first transistor ST1 connected to the jth data line DLj and the gate electrode of the driving transistor DT and the second transistor ST2 connected to the jth sensing line SSLj and the source electrode of the driving transistor DT. In the pixel PX in accordance with the embodiment of the present disclosure, turn-on of the first and second transistors ST1 and ST2 and a voltage supplied to the jth data line DLj are controlled, so that a threshold voltage of the driving transistor DT can be sensed.

Figure 4:
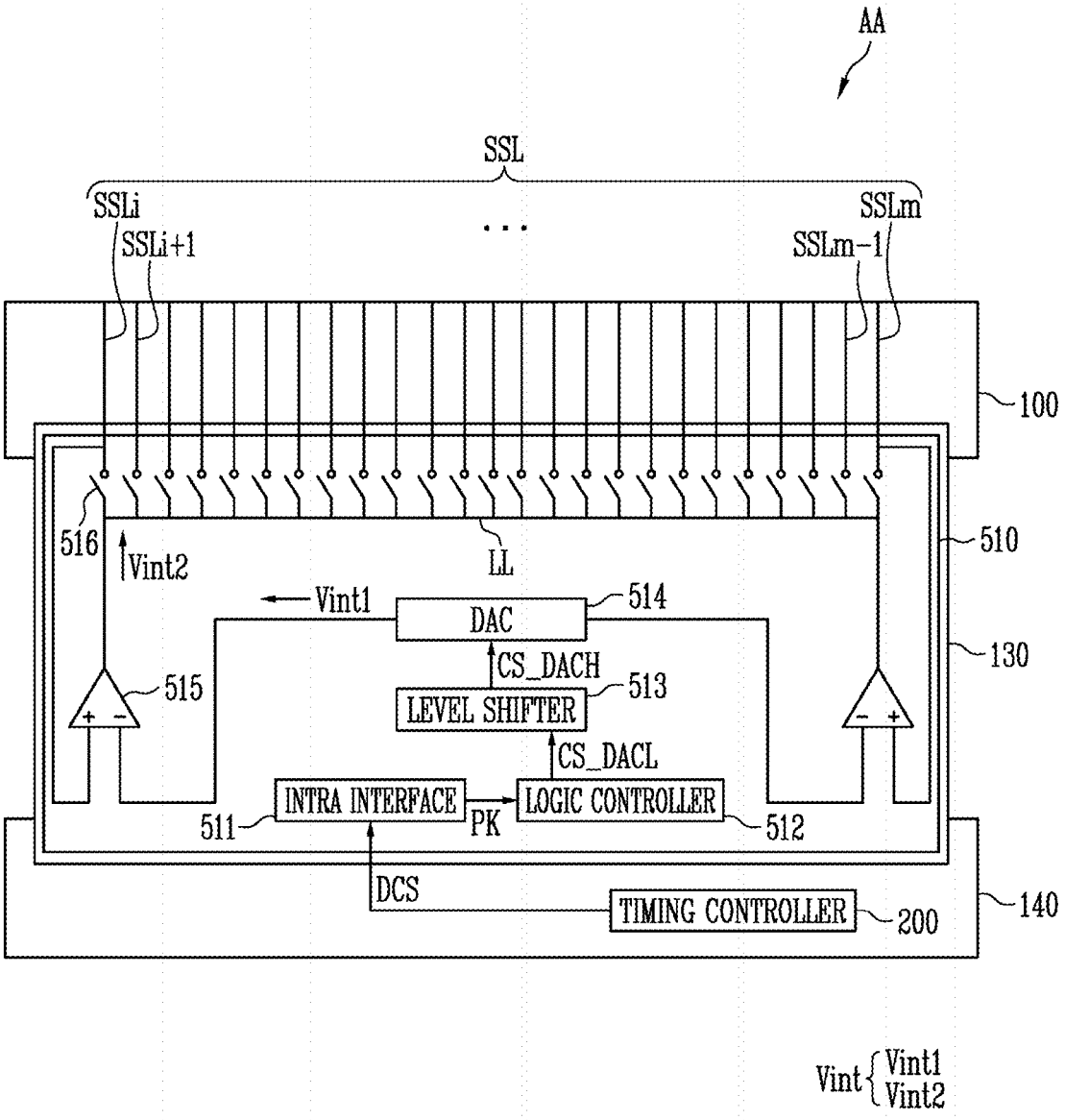
FIG. 4 is an enlarged schematic block diagram of a source driver, illustrating area AA shown in FIG. 1.
Figure 5:
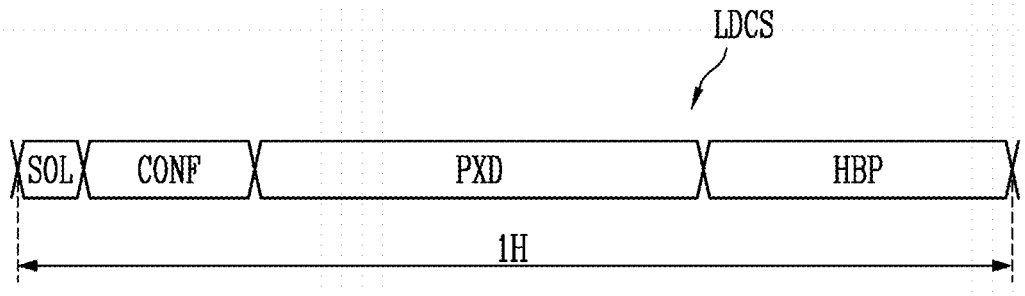
FIG. 5 is diagram illustrating one of line image data supplied through active lines.
Figure 6:
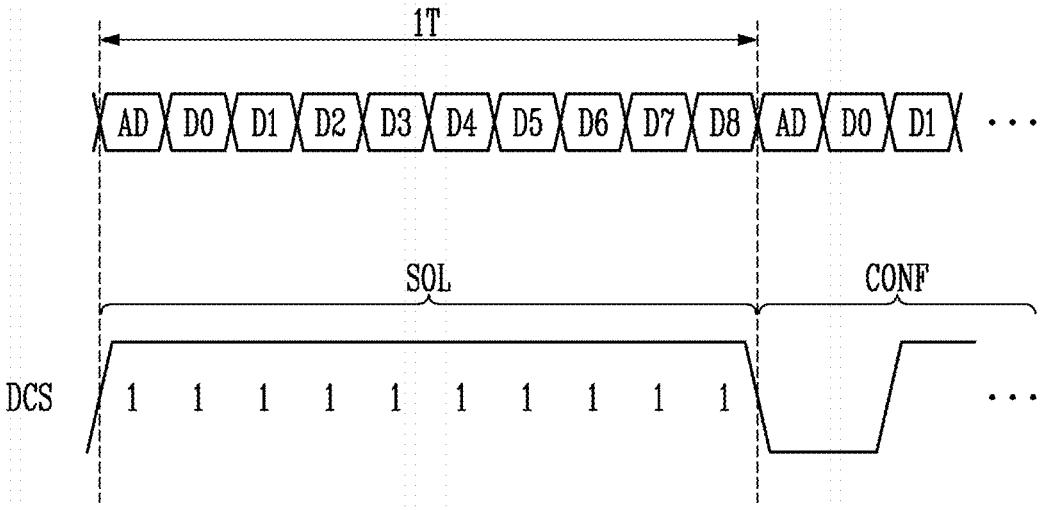
FIG. 6 is a diagram illustrating start of line ("SOL") data shown in FIG. 5.
Figure 7:
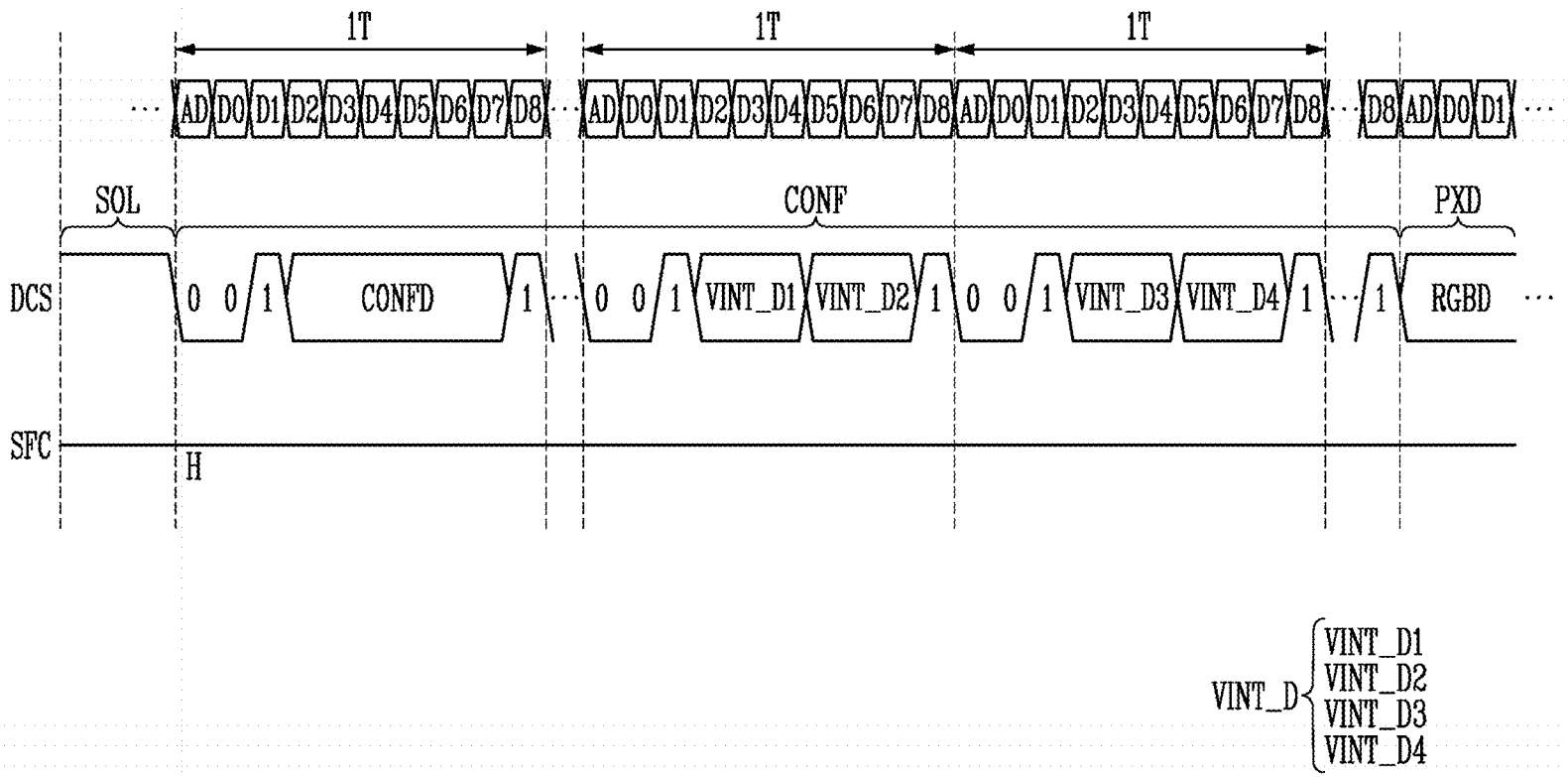
FIG. 7 is a diagram illustrating configuration control data shown in FIG. 5.
Figure 9:
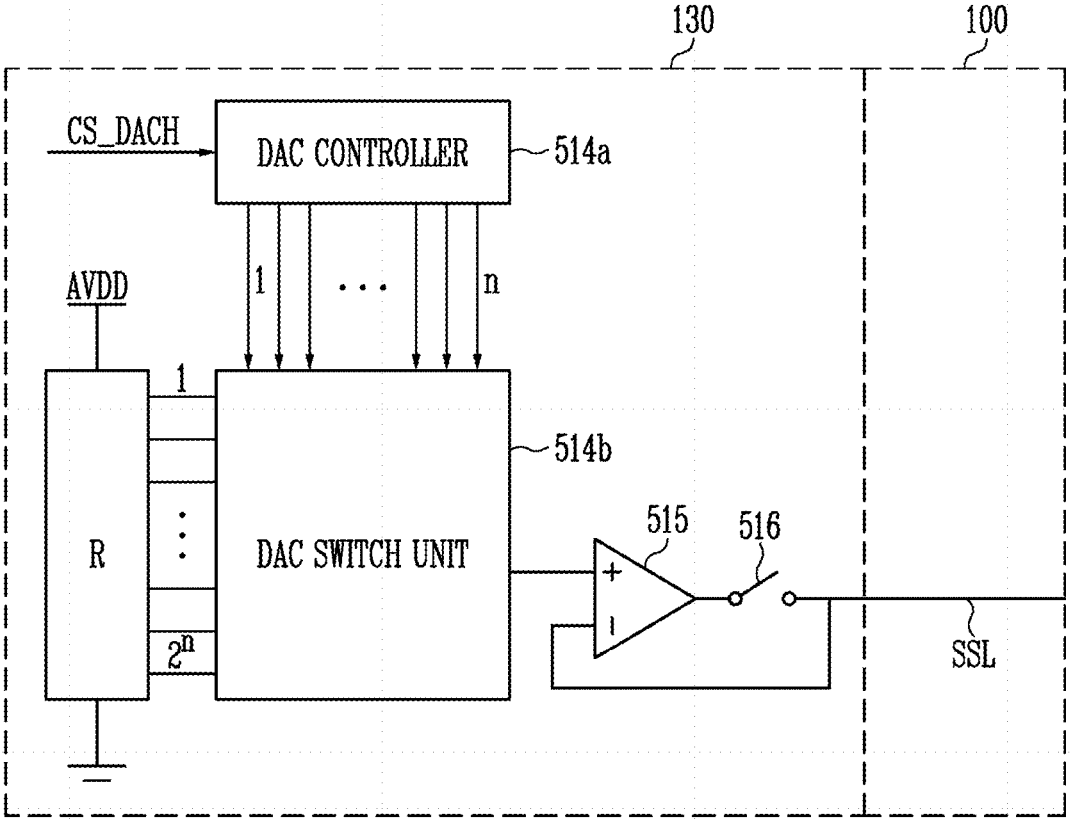
FIGS. 9 and 10 are diagrams illustrating that an initialization voltage is generated by using a digital-analog converter in accordance with an embodiment of the present disclosure.
Figure 10:
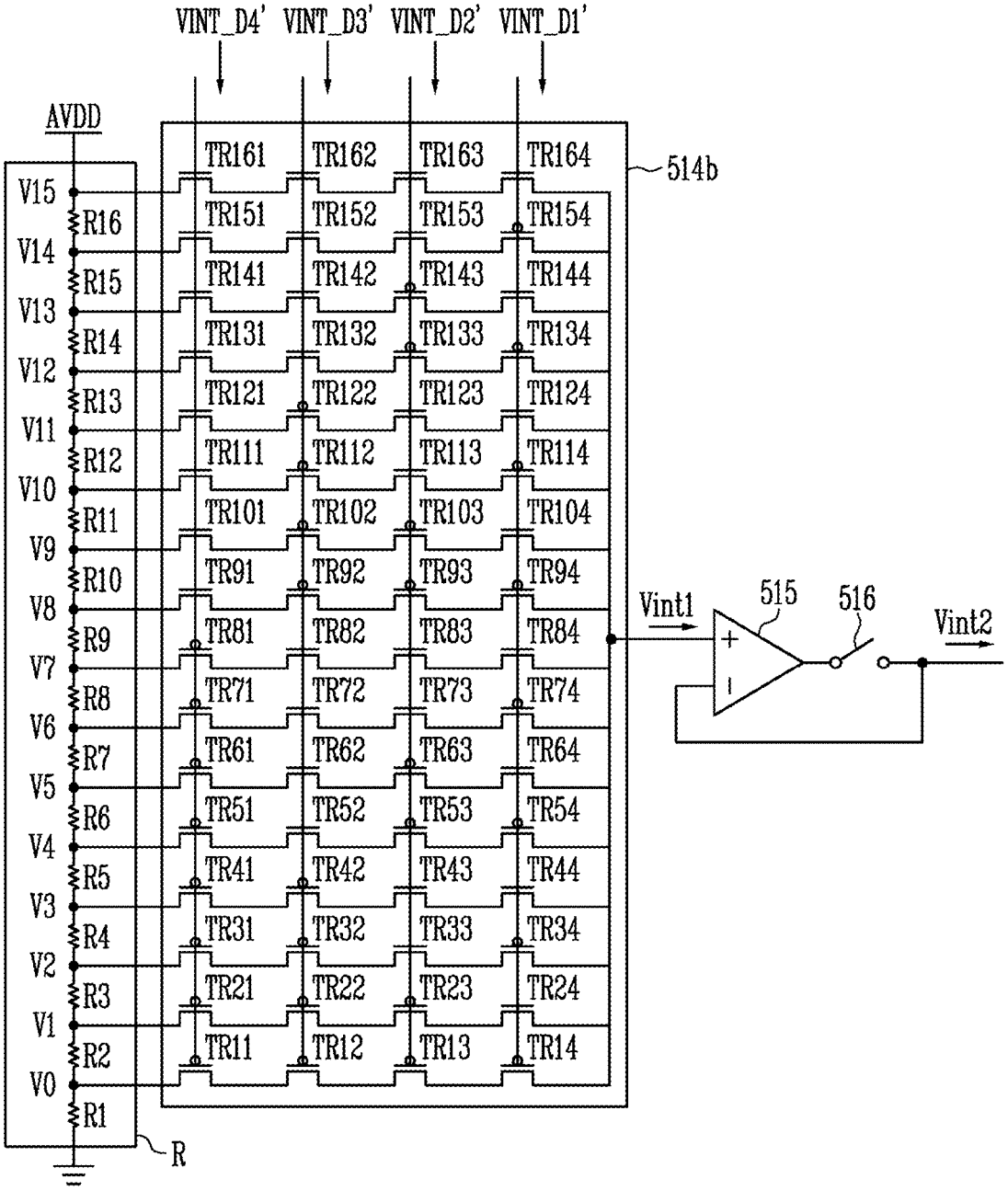

FIG. 4 is an enlarged schematic block diagram of a source driver, illustrating area AA shown in FIG. 1. FIG. 5 is diagram illustrating one of line image data supplied through active lines. FIG. 6 is a diagram illustrating start of line ("SOL") data shown in FIG. 5. FIG. 7 is a diagram illustrating configuration control data shown in FIG. 5. FIG. 8 is a diagram illustrating packet information shown in FIG. 4. FIGS. 9 and 10 are diagrams illustrating that an initialization voltage is generated by using a digital-analog converter in accordance with an embodiment of the present disclosure.

Referring to FIG. 4, the source driver 510 may include an intra interface 511, a logic controller 512, a level shifter 513, a digital-analog converter ("DAC") 514, a buffer amplifier 515, and an initialization voltage switch 516.

In accordance with an embodiment of the present disclosure, the timing controller 200 may provide the intra interface 511 with a data control signal DCS per image frame. The image frame may mean a unit period in which the display panel 100 displays one still image. A moving image moved by combining a plurality of image frames may be displayed through the display panel 100.

A frame period of each image frame may include a vertical blank period and an active data period. The active data period may be a supply period of grayscale values constituting an image frame which the pixels PX of the display panel 100 are to display. The vertical blank period may be located between an active data period of a previous frame and an active data period of a current frame. That is, the active data period may be performed after the vertical blank period. For example, clock training, frame configuration, and dummy pixel data supply may be performed during the vertical blank period. A plurality of line image data LDCS may be supplied to each of a plurality of active lines during the active data period. Each active line may correspond to a pixel row corresponding to each of the scan lines SL1 to SLn.

As shown in FIG. 5, each line image data LDCS may include SOL data SOL, configuration control data CONF, pixel data PXD, and horizontal blank period data HBP. In the active data period, pixel data PXD and control data SOL, CONF, and HBP about each of the plurality of active lines may be supplied to the data driver 500.

As shown in FIGS. 6 and 7, SOL data SOL, configuration control data CONF, and initialization voltage control data VINT_D may include a plurality of unit data, and each of the unit data may be configured with 10 bits (AD, D0, D1, D2, D3, D4, D5, D6, D7, and D8.

A period in which one unit data is supplied may be referred to as one period 1T. Each unit data may include a transition bit AD. Although the transition bit AD may be set differently according to products, the transition bit AD may be set to have a level different from that of a just previous bit. According to products, the transition bit AD may be set to have a level different from a next bit. For example, the transition bit AD may notify start of each unit data.

Referring to FIG. 6, the SOL data SOL may notify the source driver (510 shown in FIG. 4) that the supply of a signal for a changed pixel row is to be started. In this embodiment, a unit data column of the SOL data SOL is configured with 1111111111, but may be changed according to products. The configuration control data CONF may be provided after the SOL data SOL is provided.

Referring to FIG. 7, the configuration control data may include unit data columns of 10 bits which starts with 001 and ends with 1, and may include operation option data CONFD for controlling an operation option of the source driver 510 in the middle thereof. For example, the operation option data CONFD may notify of a kind of subsequent data. The data subsequent to the configuration control data CONF may be pixel data PXD or dummy pixel data (not shown).

At least a portion of a plurality of unit data included in the configuration control data CONF may include initialization voltage control data VINT_D. The initialization voltage control data VINT_D may be data for controlling the magnitude of the target initialization voltage Vint.

In an embodiment, for example, the configuration control data CONF may include first initialization voltage control data VINT_D1, second initialization voltage control data VINT_D2, third initialization voltage control data VINT_D3, and fourth initialization voltage control data VINT_D4. As for the initialization voltage control data VINT_D1, VINT_D2, VINT_D3, and VINT_D4, two initialization voltage control data VINT_D may be included in one unit data column as shown in FIG. 7. However, the present disclosure according to the invention is not limited thereto, and one initialization voltage control data VINT_D may be included in one unit data column.

The pixel data PXD may include pixel grayscale data RGBD such that the other bits D0, D1, D2, D3, D4, D5, D6, D7, and D8 except the transition bit AD of the unit data express a grayscale value of a corresponding pixel. The configuration of the pixel data PXD may be changed according to products. The horizontal blank period data HBP may be provided after the pixel data PXD is provided.

The supply period of the horizontal blank period data HBP may be controlled by the configuration control data CONF. The source driver 510 may determine whether a pixel row (e.g., pixels connected to the same scan line) corresponding to the pixel data PXD is to be changed.

In accordance with the embodiment of the present disclosure, the initialization voltage control data VINT_D in a digital format is provided to the intra interface 511 of the source driver 510 mounted on the flexible film 130 from the timing controller 200 mounted on the first PCB 140, so that a signal in a digital format with respect to a target initialization voltage Vint can be transferred to the source driver 510, regardless of resistance of an electric wire between the timing controller 200 and the intra interface 511 and/or a variation in bonding resistance between the first PCB 140 and the flexible film 130.

Referring back to FIG. 4, the intra interface 511 may extract only packet information PK associated with the initialization voltage control data VINT_D from the data control signal DCS and provide the extracted packet information PK to the logic controller 512.

The logic controller 512 may output a first control signal CS_DACL for controlling the level shifter 513, based on the packet information PK. The first control signal CS_DACL may have a digital format.

Referring to FIGS. 7 and 8, the packet information PK may be configured with 4-bit data. The magnitude of the target initialization voltage Vint may be controlled to be subdivided into 16 according to a value of the initialization voltage control data VINT_D included in the packet information PK. However, the present disclosure according to the invention is not limited thereto, and the magnitude of the target initialization voltage Vint may be controlled to be further subdivided, when the configuration control data CONF includes the initialization voltage control data VINT_D of a larger number of bits.

In an embodiment, for example, when the packet information PK has data of 0000 in an order of the fourth initialization voltage control data VINT_D4, the third initialization voltage control data VINT_D3, the second initialization voltage control data VINT_D2, and the first initialization voltage control data VINT_D1, the logic controller 512 may output the first control signal CS_DACL in which the magnitude of the target initialization voltage Vint is V0 [V].

Similarly, when the packet information PK has data of 0001, the logic controller 512 may output the first control signal CS_DACL in which the magnitude of the target initialization voltage Vint is V1 [V]. When the packet information PK has data of 1110, the logic controller 512 may output the first control signal CS_DACL in which the magnitude of the target initialization voltage Vint is V14 [V]. When the packet information PK has data of 1111, the logic controller 512 may output the first control signal CS_DACL in which the magnitude of the target initialization voltage Vint is V15 [V]. The magnitude of the initialization voltage Vint may increase as approaching V15 [V] from V0 [V].

Referring back to FIG. 4, the level shifter 513 may receive the first control signal CS_DACL and output a second control signal CS_DACH.

In an embodiment, for example, the second control signal CS_DACH may be a pulse signal which swings between a gate high voltage and a gate low voltage. The second control signal CS_DACH may be set to a sufficient voltage level to turn on switches TR11 to TR164 included in a digital-analog converter (DAC) switch unit 514*b* which will be described later in FIG. 10.

The DAC 514 may generate a target initialization voltage Vint, based on the second control signal CS_DACH.

Referring to FIGS. 9 and 10, a DAC 514, a buffer amplifier 515, an initialization voltage switch 516, and a voltage divider R may be mounted on the flexible film 130 connected to the display panel 100. However, this is for convenience of description, and the position of the voltage divider R according to the invention is not limited thereto. For example, the voltage divider R may be disposed on the first PCB 140 or the second PCB 160.

The voltage divider R may divide a driving voltage AVDD in an analog format, and generate a plurality of initialization voltages Vint (V0 to V15). The initialization voltages Vint may be voltages for compensating for an initialization operation and a threshold voltage of a pixel.

The voltage divider R may be connected to an input terminal of the DAC switch unit 514*b* through $2^n$ channels, and provide the DAC switch unit 514*b* with divided voltages V0 to V15 (see FIG. 10) through the $2^n$ channels.

In an embodiment, for example, the driving voltage AVDD may be applied to a first terminal of the voltage divider R, and a ground voltage may be applied to a second terminal of the voltage divider R. The voltage divider R may include $2^n$ resistors connected in series between the first terminal and the second terminal. For example, the voltage divider R may include first to sixteenth resistors R1 to R16 connected in series. The first to sixteenth resistors R1 to R16 may be resistors having the same magnitude. Thus, the voltage divider R divides the driving voltage AVDD by using the first to sixteenth resistors R1 to R16, thereby linearly generating the plurality of initialization voltages Vint (V0 to V15).

The DAC 514 may include a DAC controller 514*a* and the DAC switch unit 514*b*.

The DAC controller 514*a* may receive the second control signal CS_DACH from the level shifter 513. The DAC controller 514*a* may change the second control signal CS_DACH to an n-bit signal.

In an embodiment, for example, the DAC controller 514*a* may change the second control signal CS_DACH to a 4-bit signal. The 4-bit signal may include (4_1)th initialization voltage control data VINT_D4, (3_1)th initialization voltage control data VINT_D3, (2_1)th initialization voltage control data VINT_D2, and (1_1)th initialization voltage control data VINT_D1, which correspond to the fourth initialization control data VINT_D4, the third initialization control data VINT_D3, the second initialization control data VINT_D2, and the first initialization control data VINT_D1, respectively, which are shown in FIG. 8. The (4_1)th initialization voltage control data VINT_D4, the (3_1)th initialization voltage control data VINT_D3, the (2_1)th initialization voltage control data VINT_D2, and the (1_1)th initialization voltage control data VINT_D1 may be set to a sufficient voltage level to turn on switches TR11 to TR164 included in the DAC switch unit 514*b* shown in FIG. 10.

The DAC switch unit 514*b* may be connected to the DAC controller 514*a* through *n* channels, and include a plurality of switches TR11 to TR164 arranged in a matrix form configured with $2^n$ rows and n columns.

The plurality of switches TR11 to TR164 may be configured with a combination of N-type transistors and P-type transistors, and the N-type transistors and the P-type transistors may be arranged such that only switches disposed on any one row among the $2^n$ rows are all turned on corresponding to an n-bit signal provided from the DAC controller 514*a*.

In an embodiment, for example, each of the rows of the plurality of switches TR11 to TR164 arranged in the matrix form may correspond to a value obtained by converting any one of 0 to 15, which is expressed as a decimal number, into a binary number. "0" may be configured with a P-type transistor, and "1" may be configured with an N-type transistor.

Since transistors of a first row, which are configured with an eleventh transistor TR11, a twelfth transistor TR12, a thirteenth transistor TR13, and a fourteenth transistor TR14, correspond to "0000" obtained by converting 0 expressed as a decimal number into a binary number, the transistors of the first row may all be configured with the P-type transistor. Since transistors of a second row, which are configured with a twenty-first transistor TR21, a twenty-second transistor TR22, a twenty-third transistor TR23, and a twenty-fourth transistor TR24, correspond to "0001" obtained by converting 1 expressed as a decimal number into a binary number, the twenty-first transistor TR21, the twenty-second transistor TR22, and the twenty-third transistor TR23 may be configured with the P-type transistor, and the twenty-fourth transistor T24 may be configured with the N-type transistor.

By applying the same rule to the other rows, types of the other transistors may be determined, and the other transistors may be arranged. Since transistors of a last sixteenth row, which are configured with a 161st transistor TR161, a 162nd transistor TR162, a 163rd transistor TR163, and a 164th transistor TR164, correspond to "1111" obtained by converting "15" expressed as a decimal number into a binary number, the transistors of the sixteenth row may all be configured with the N-type transistor.

When a 4-bit signal provided from the DAC controller 514*a* has data "0000" in an order of the (4_1)th initialization voltage control data VINT_D4, the (3_1)th initialization voltage control data VINT_D3, the (2_1)th initialization voltage control data VINT_D2, and the (1_1)th initialization voltage control data VINT_D1, the transistors of the first row, which are configured with the eleventh transistor TR11, the twelfth transistor TR12, the thirteenth transistor TR13, and the fourteenth transistor TR14, are all turned on, and therefore, a first initialization voltage Vint1 having a magnitude of V0 [V], which is connected to one terminal of the eleventh transistor TR11, may be provided to a non-inverting terminal of the buffer amplifier 515. 0 may correspond to a logic low level, and 1 may correspond to a logic high level.

Since the transistors of the second to sixteenth rows include at least one N-type transistor, the at least one N-type transistor is turned off in response to the data "0000", and therefore, an electrical disconnection may occur. Accordingly, only the transistors of the first row among the transistors of the first to sixteenth rows, which are arranged between the input terminal and an output terminal of the DAC switch unit 514*b*, may be electrically connected.

The buffer amplifier 515 may be configured as an operational amplifier, and have a negative feedback structure in which a non-inverting input terminal is connected to an output terminal of the DAC 514, and an output terminal and an inverting input terminal of the operational amplifier are connected to each other.

The buffer amplifier 515 may be connected to a plurality of sensing lines SSL through a plurality of initialization voltage switches 516.

Referring to FIG. 4, the buffer amplifier 515 may be mounted at each of opposite ends of the source driver 510. However, this is merely illustrative, and a number of buffer amplifiers 515 may be one or two or more. For example, the number of buffer amplifiers 515 may be equal to that of the sensing lines SSL1 to SSLm.

The buffer amplifier 515 may be connected to the plurality of sensing lines SSLi to SSLm through the plurality of initialization voltage switches 516. In accordance with an embodiment of the present disclosure, output terminals of the two buffer amplifier 515 mounted at opposite ends of the source driver 510 may be electrically connected to each other through a line LL, and the line LL may be connected to first ends of the plurality of initialization voltage switches 516 corresponding to the plurality of sensing lines SSLi to SSLm in a one-to-one manner. The first end of each of the initialization voltage switches 516 may be connected to the output terminal of the buffer amplifier 515 and the line LL, and a second end (i.e., the other end) of each of the initialization voltage switches 516 may be connected to one of the plurality of sensing lines SSL1 to SSLm.

The first end of each of the initialization voltage switches 516 directly connected to the output terminals of the two buffer amplifier 515 mounted at opposite ends of the source driver 510 may be connected to the output terminal of the operational amplifier, and the second end (i.e., the other end) of each of the initialization voltage switches 516 may be connected to the inverting input terminal of the operational amplifier. Thus, when the initialization voltage switches 516 are turned on, a magnitude of a first initialization voltage Vint1 input to the non-inverting input terminal of the operational amplifier and a magnitude of a second initialization voltage Vint2 output to the output terminal of the operational amplifier can be maintained substantially equal to each other. In other words, the target initialization voltage Vint output from the DAC 514 can be constantly maintained, regardless of a variation in bonding resistance between the display panel 100 and the flexible film 130. The first initialization voltage Vint1 and the second initialization voltage Vint2 may have an analog format.

In the display device in accordance with the present disclosure, a reference voltage (or initialization voltage) is provided in a digital format to the source driver, so that a change in the reference voltage can be minimized.

Further, in the display device in accordance with the present disclosure, the reference voltage is provided from the source driver to the display panel through the buffer amplifier, so that a change in the reference voltage can be compensated.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims.

What is claimed is:

1. A source driver comprising:

an intra interface which receives a data control signal and outputs packet information associated with a target initialization voltage extracted from the data control signal, wherein the packet information is in a digital format;

a digital-analog converter which generate the target initialization voltage in an analog format, based on the packet information, and a logic controller disposed between the intra interface and the digital-analog converter, wherein the logic controller generates a first control signal for controlling the digital-analog converter, based on the packet information.

2. The source driver of claim 1, further comprising a level shifter disposed between the logic controller and the digital-analog converter, wherein the level shifter boosts the first control signal to a second control signal capable of operating the digital-analog converter.

3. The source driver of claim 2, further comprising a buffer amplifier disposed between a sensing line and the digital-analog converter, wherein the sensing line is connected to a pixel.

4. The source driver of claim 2, wherein the digital-analog converter comprises:

a digital-analog converter controller which converts the second control signal to an n-bit signal; and a digital-analog converter switch unit connected to the digital-analog converter controller through n channels, and including a plurality of switches arranged in a matrix form configured with $2^n$ rows and n columns, wherein n is a natural number.

5. The source driver of claim 4, wherein the digital-analog converter further comprises a voltage divider including $2^n$ resistors electrically connected in series between a first terminal to which a driving voltage in an analog format is applied and a second terminal to which a ground voltage is applied, and The digital-analog converter switch unit receives a plurality of initialization voltages generated by dividing the driving voltage by the voltage divider and selects one of the plurality of initialization voltages as the target initialization voltage.

6. The source driver of claim 5, wherein the voltage divider is connected to the digital-analog converter switch unit through $2^n$ channels, and provides the plurality of initialization voltages to the digital-analog converter switch unit through the $2^n$ channels.

7. The source driver of claim 6, wherein the switches are configured with a combination of N-type transistors and P-type transistors, and wherein the N-type transistors and the P-type transistors are arranged such that only switches disposed in one row among the $2^n$ rows are all turned on, corresponding to the n-bit signal.

8. A display device comprising:

a display panel including a plurality of pixels;

a source driver which outputs a target initialization voltage in an analog format to the pixels through sensing lines; and a timing controller which provides the source driver with a data control signal including packet information associated with the target initialization voltage, wherein the packet information is in a digital format, and the source driver includes:

a digital-analog converter which generates the target initialization voltage in the analog format, based on the packet information;

an intra interface which receives the data control signal and outputs the packet information included in the data control signal; and a logic controller disposed between the intra interface and the digital-analog converter;

wherein the logic controller generates a first control signal for controlling the digital-analog converter, based on the packet information.

9. The display device of claim 8, wherein the source driver further includes a level shifter disposed between the logic controller and the digital-analog converter, and the level shifter boosts the first control signal to a second control signal capable of operating the digital-analog converter.

10. The display device of claim 9, further comprising a buffer amplifier disposed between the sensing lines and the digital-analog converter.

11. The display device of claim 9, wherein the digital-analog converter includes:

a digital-analog converter controller which converts the second control signal to an n-bit signal; and a digital-analog converter switch unit connected to the digital-analog converter controller through n channels, and including a plurality of switches arranged in a matrix form configured with $2^n$ rows and n columns, wherein n is a natural number.

12. The display device of claim 11, further comprising a voltage divider including $2^n$ resistors electrically connected in series between a first terminal to which a driving voltage in an analog format is applied and a second terminal to which a ground voltage is applied, wherein the voltage divider outputs a plurality of divided voltages by dividing the driving voltage.

13. The display device of claim 12, wherein the voltage divider is connected to the digital-analog converter switch unit through $2^n$ channels, and provides the divided voltages to the digital-analog converter switch unit through the $2^n$ channels.

14. The display device of claim 13, wherein the switches are configured with a combination of N-type transistors and P-type transistors, and wherein the N-type transistors and the P-type transistors are arranged such that only switches disposed in one row among the $2^n$ rows are all turned on, corresponding to the n-bit signal.

15. The display device of claim 8, wherein each of the pixels are connected to a scan line, a data line, and a sensing control line, and wherein each of the pixels includes:

a driving transistor including a first electrode connected to a first power voltage line, a second electrode connected to an anode of a light emitting device, and a gate electrode connected to a first node;

a first transistor including a first electrode connected to the data line, a second electrode connected to the first node, and a gate electrode connected to the scan line;

a second transistor including a first electrode connected to the sensing line, a second electrode connected to the anode of the light emitting device, and a gate electrode connected to the sensing control line; and a capacitor connected between the first node and the anode of the light emitting device.

16. The display device of claim 15, wherein the data line receives a part of a data signal, the data signal includes a plurality of line image data, and each of the line image data includes start of line (SOL) data, configuration control data, pixel data, and horizontal blank period data.

17. The display device of claim 8, further comprising:

a printed circuit board on which the timing controller is mounted, and a flexible film on which the source driver is mounted, wherein the display panel and the printed circuit board are connected to each other by the flexible film.

18. The display device of claim 17, wherein the flexible film is provided in a chip on film (COF) manner or a chip on plastic (COP) manner.

* * * * *